US005247898A

United States Patent [19]

Thornlimb

[11] Patent Number: 5,247,898

[45] Date of Patent: Sep. 28, 1993

[54] WATER-SKI BOARD

[76] Inventor: Craig R. Thornlimb, 23 Belt St., Warwick, R.I. 02889

[21] Appl. No.: 999,267

[22] Filed: Dec. 31, 1992

[51] Int. Cl.[5] ..... B63B 35/81

[52] U.S. Cl. ..... 114/246; 114/163; 114/253; 441/65; 441/79

[58] Field of Search ..... 114/244, 246, 253, 315, 114/163; 441/65, 79

[56] References Cited

U.S. PATENT DOCUMENTS 2,958,875 11/1960 McClain ..... 441/79
3,469,552 9/1969 Patrick ..... 114/246
3,824,945 7/1974 Casciano ..... 114/246
4,361,103 11/1982 Willat ..... 441/79
4,708,675 11/1987 Shoeffler et al. ..... 441/79
5,076,189 12/1991 Jones ..... 114/253

*Primary Examiner*—Sherman Basinger
*Assistant Examiner*—Thomas J. Brahan
*Attorney, Agent, or Firm*—Leon Gilden

[57] ABSTRACT

A ski board is arranged to include a polymeric skin envelope housing a foam core, to include a rear wall having a plurality of parallel troughs orthogonally intersecting the rear wall canted upwardly towards the top wall to receive the leg portions of an individual therewithin. A rudder control handle is mounted forwardly and in alignment with each trough between each trough and the forward wall of the ski board structure. A tow ring mounted medially of the rudders in adjacency to the forward wall is arranged to receive a tow rope for towing of the organization.

4 Claims, 4 Drawing Sheets

WATER-SKI BOARD

BACKGROUND OF THE INVENTION

1. Field of the Invention

The field of invention relates to water board structure, and more particilarly pertains to a new and improved water-ski board wherein the same is arranged for the stable positioning of an individual relative to a tow boat in a water-skiing event.

2. Description of the Prior Art

Water boards of various types have been utilized in the prior art, wherein to enhance stability and enjoyment, the ski board of the instant invention permits stability as well as the ease of maneuverability of the organization in use. Prior art structure as indicated in U.S. Pat. Nos. 4,241,929; 4,138,129; 4,784,233; and 4,161,324 have heretofore failed to provide for the maneuverability and control, as well as the stability in use of the organization in permitting an individual to assume a lower center of gravity in mounting the ski board structure of the instant invention and in this respect, the present invention substantially fulfills this need.

SUMMARY OF THE INVENTION

In view of the foregoing disadvantages inherent in the known types of ski board apparatus now present in the prior art, the present invention provides a water-ski board wherein the same is arranged to the positioning of an individual in proximity to a top wall of the ski board to afford stability to the organization, as well as maneuverability by steerage of utilizing rudder structure. As such, the general purpose of the present invention, which will be described subsequently in greater detail, is to provide a new and improved water-ski board which has all the advantages of the prior art ski board apparatus and none of the disadvantages.

To attain this, the present invention provides a ski board arranged to include a polymeric skin envelope housing a foam core, to include a rear wall having a plurality of parallel troughs orthogonally intersecting the rear wall canted upwardly towards the top wall to receive the leg portions of an individual therewithin. A rudder control handle is mounted forwardly and in alignment with each trough between each trough and the forward wall of the ski board structure. A tow ring mounted medially of the rudders in adjacency to the forward wall is arranged to receive a tow rope for towing of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water-ski board which has all the advantages of the prior art ski board apparatus and none of the disadvantages.

It is another object of the present invention to provide a new and improved water-ski board which may be easily and efficiently manufactured and marketed.

It is a further object of the present invention to provide a new and improved water-ski board which is of a durable and reliable construction.

An even further object of the present invention is to provide a new and improved water-ski board which is susceptible of a low cost of manufacture with regard to both materials and labor, and which accordingly is then susceptible of low prices of sale to the consuming public, thereby making such water-ski boards economically available to the buying public.

Still yet another object of the present invention is to provide a new and improved water-ski board which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
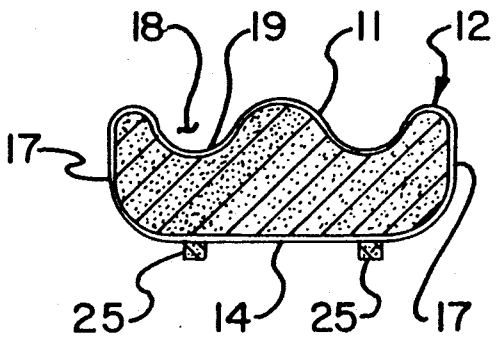
FIG. 2 is an orthographic view, taken along the lines 2—2 of FIG. 1 in the direction indicated by the arrows.
Figure 1:
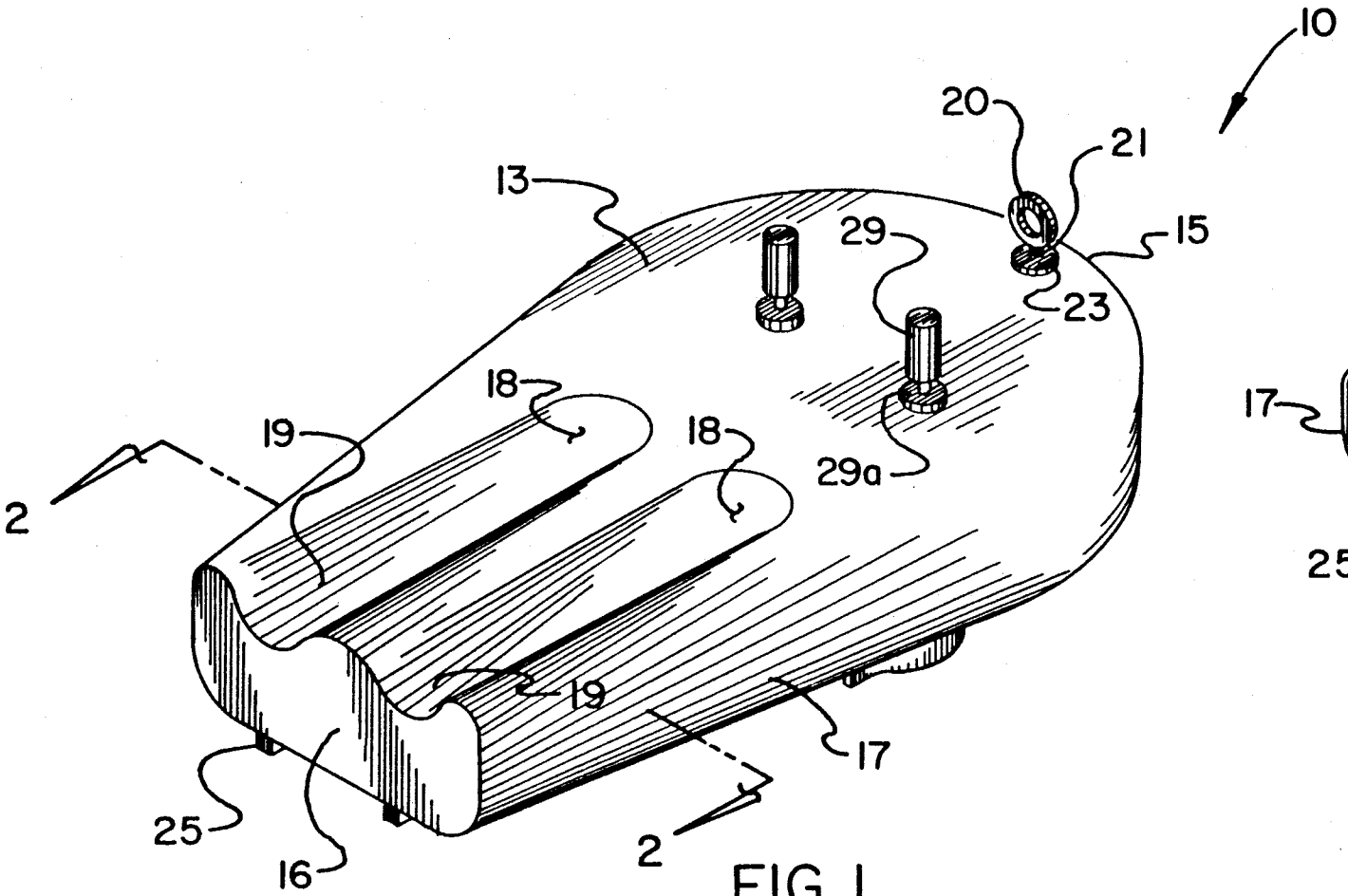
FIG. 1 is an isometric illustration of the instant invention.
Figure 3:
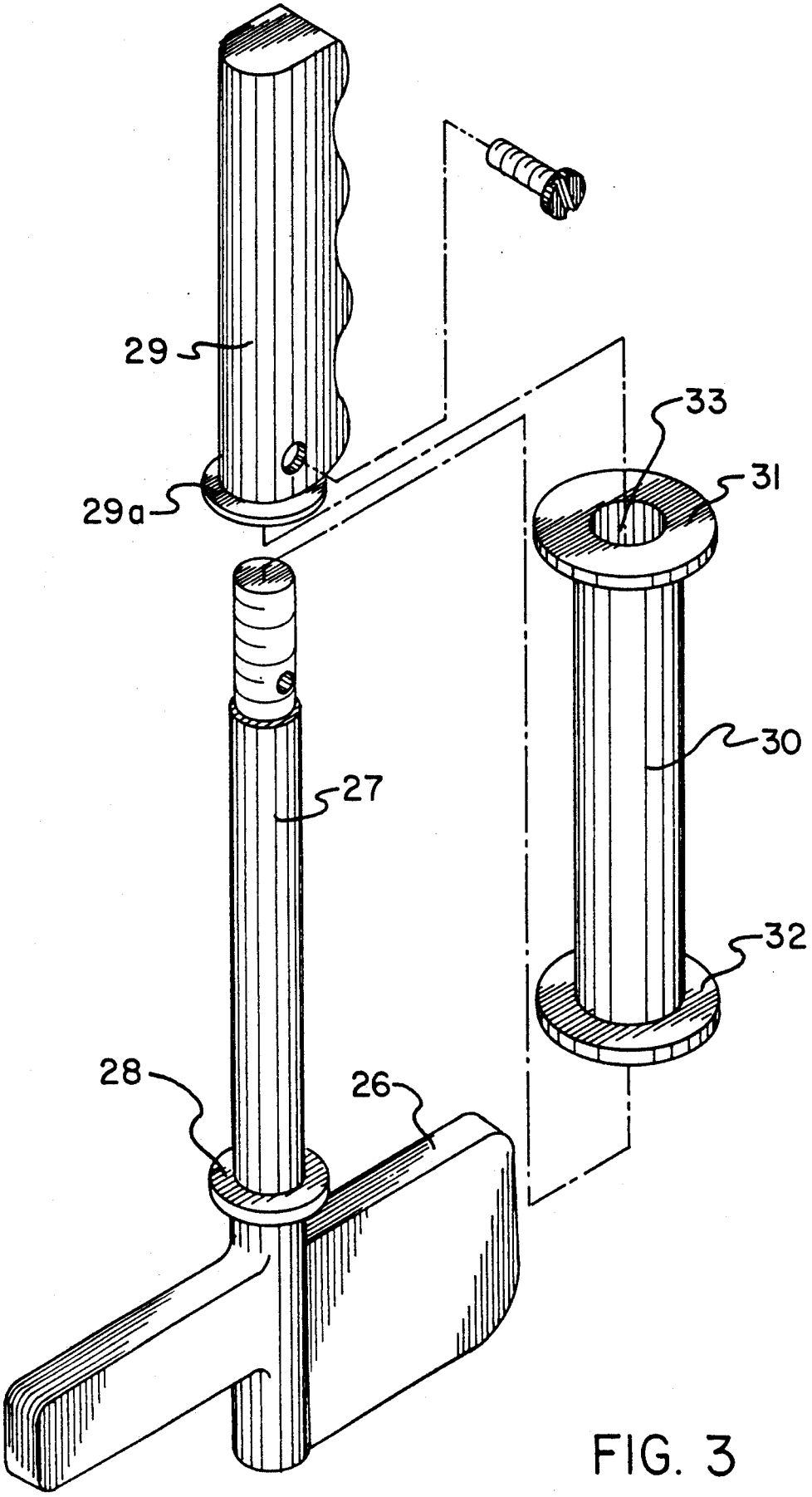
FIG. 3 is an isometric exploded view of each rudder member of the invention.
Figure 4:
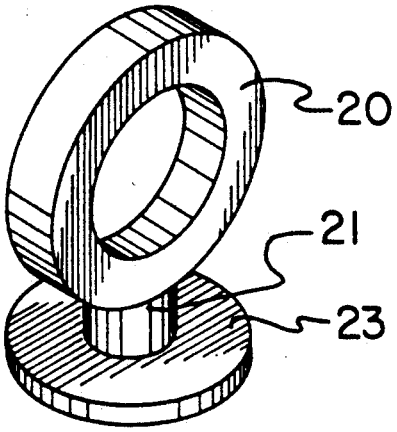
FIG. 4 is an isometric illustration of the tow ring structure of the invention.
Figure 5:
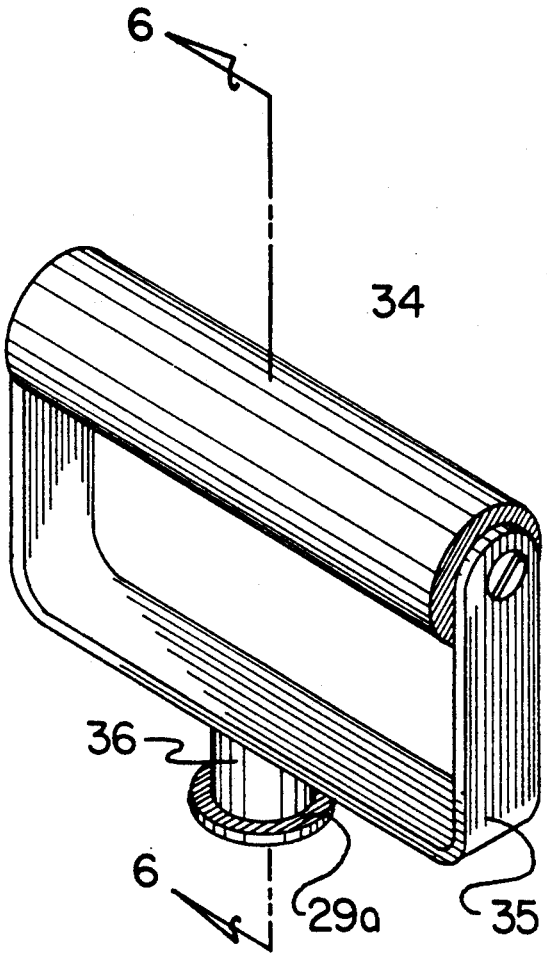
FIG. 5 is an isometric illustration of a modified handle structure utilized by the invention.
Figure 6:
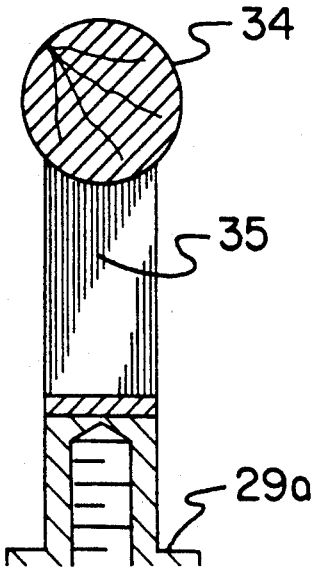
FIG. 6 is an orthographic view, taken along the lines 6—6 of FIG. 5 in the direction indicated by the arrows.
Figure 7:
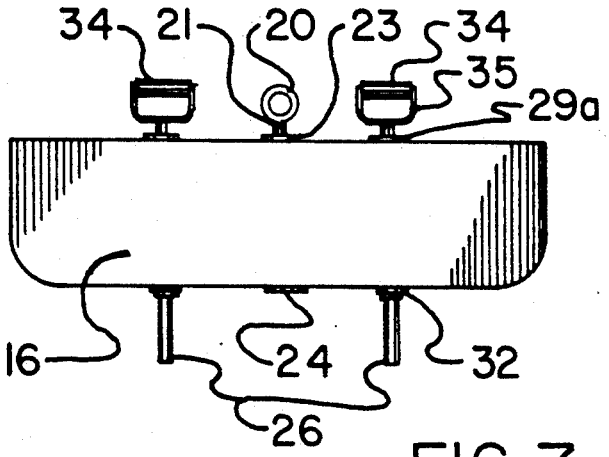
FIG. 7 is an orthographic rear view of the ski board structure.
Figure 8:
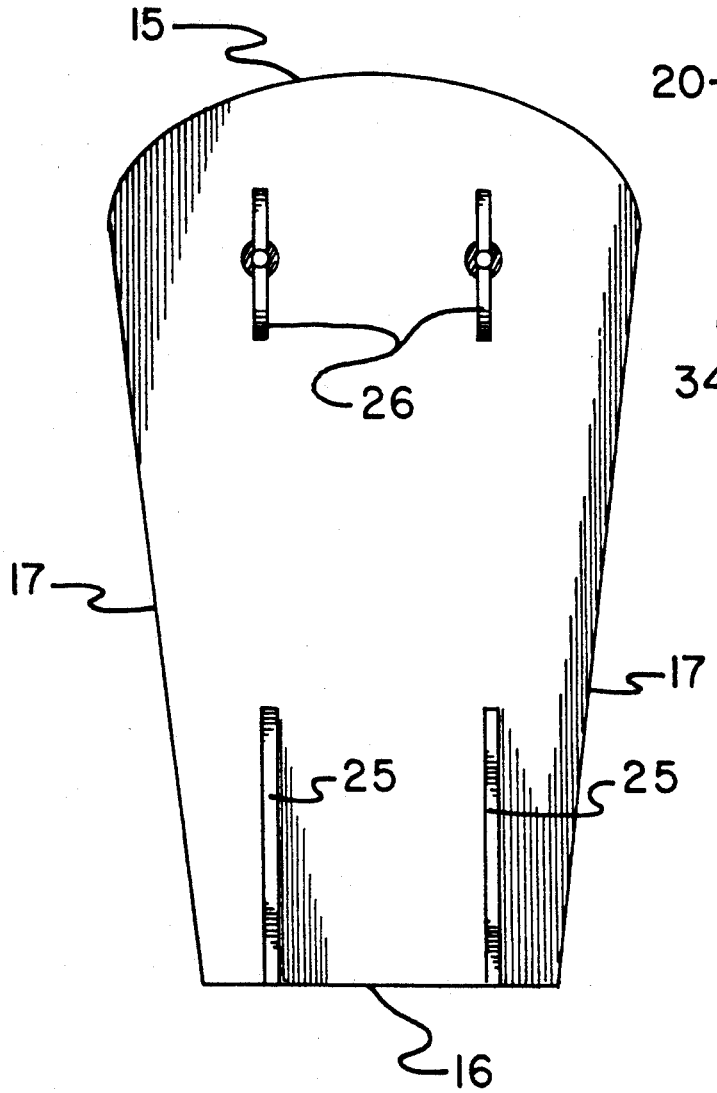
FIG. 8 is an orthographic bottom view of the ski board structure.
Figure 9:
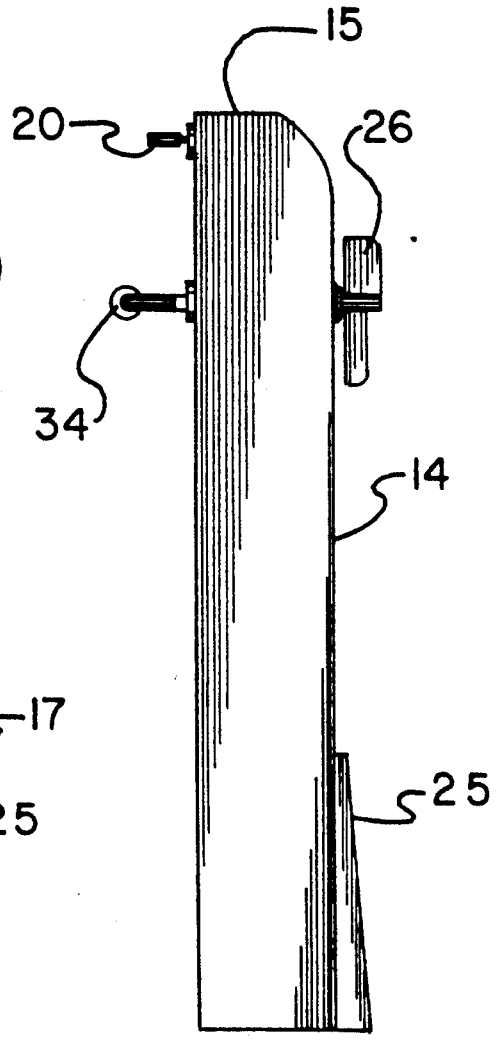
FIG. 9 is an orthographic side view of the ski board structure.

With reference now to the drawings, and in particular to FIGS. 1 to 9 thereof, a new and improved water-ski board embodying the principles and concepts of the present invention and generally designated by the reference numeral 10 will be described.

More specifically, the water-ski board 10 of the instant invention essentially comprises a unitary board member having a polymeric foam core surrounded by a polymeric rigid outer skin envelope 12 to maintain geometric integrity to the organization. Alternatively, the body is pneumatically filled with pressurized air to provide buoyancy to the structure. The board structure includes a board top wall 13 spaced from a board bottom wall 14. A planar rear wall 16 is orthogonally intersecting the bottom wall 14 and the top wall 13. A convex arcuate forward wall 15 is directed between side walls 17, as indicated.

A plurality of parallel convex trough members 18 orthogonally intersecting the rear wall 16 extend parallel relative to one another in equal spacings relative to an adjacent respective side wall 17 relative to a respective trough member 18. The trough members extend from the rear wall through the top wall terminating in a spaced relationship relative to the forward wall 15. Each trough member 18 includes an arcuate concave trough floor 19 canted upwardly from the rear wall 16 to the forward distal end of each trough member to provide for secure mounting of an individual's shin portion within an associated trough member 18. A tow ring 20 fixedly mounted to the forward wall 15 is fixedly and medially mounted between the side walls 17 in adjacency to the top wall 13. The ring mast 21 is arranged in coaxial and fixed alignment relative to a mast anchor post 22 having a top flange 23 typically molded to the core 11 to fixedly secure the tow ring mast structure in fixed orientation relative to the ski board organization to minimize distortion and deflection of the anchor post structure and tow ring 20 in use.

A plurality of parallel alignment fins 25 are fixedly and orthogonally mounted to the bottom wall 14 intersecting the rear wall 16 and extend from the rear wall 16 to an orientation medially of the bottom wall 14 to assist in maintaining alignment of the ski board when directed over a water medium.

A plurality of rudder plates 26 are provided, wherein an individual rudder plate 26 is positioned orthogonally at a lower distal end of a rudder shaft 27. Each rudder shaft 27 is directed through the bottom wall 14 in longitudinal alignment with a respective fin 25 between the fin 25 and the forward wall 15. The rudder shaft includes a rudder shaft lower flange 28 at an intersection of the rudder shaft 27 relative to an associated rudder plate 26. A handle sleeve flange 29 is provided having a handle sleeve flange 29*a* at a lower distal end thereof. A rudder shaft sleeve 30 is fixedly mounted orthogonally through the top and bottom walls 13 and 14. The rudder shaft sleeve includes a rudder shaft sleeve upper flange 31 in contiguous communication with a top wall 13, with a rudder shaft lower flange 32 in contiguous communication with the bottom wall. The rudder shaft 27 is thereby rotatably and complementarily received through a central bore 33 of the rudder shaft sleeve 30, with the shaft lower flange 28 in abutment with the rudder shaft sleeve lower flange. Similarly, the handle shaft flange 29*a* is in abutment with the rudder shaft sleeve upper flange 31 to maintain desired orientation and stability of the rudder shaft relative to the rudder shaft sleeve 30.

The FIGS. 5–8 indicate a modified handle structure having a handle bar 34 mounted to an upper distal end of a U-shaped bar support 35. The U-shaped bar support 35 includes U-shaped bar support shaft 36 having the handle flange 29*a* at a lower distal end thereof for abutment with the rudder shaft sleeve upper flange 31 as discussed above. The handle bar orientation 34 permits a more stable positioning and orientation relative to the board top wall 13 when mounted by a user of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water-ski board, comprising, a polymeric rigid outer skin envelope, and an air-filled core coextensive with the envelope, and a top wall spaced from a bottom wall, and a planar rear wall orthogonally intersecting the top wall and the bottom wall, and side walls extending between the top wall and the bottom wall, and a convex arcuate forward wall extending between the side walls spaced from the rear wall, and a plurality of parallel alignment fins fixedly and orthogonally mounted to the bottom wall orthogonally intersecting the planar rear wall, wherein the alignment fins extend from the rear wall in a spaced relationship relative to the forward wall, and a plurality of rudder shafts including a rudder shaft of said rudder shafts oriented in alignment with an individual alignment fin between said alignment fin and the forward wall, and the rudder shaft having a rudder plate orthogonally mounted to the rudder shaft projecting below the bottom wall, the rudder shaft having a shaft lower flange at an intersection of the rudder shaft and the rudder plate, and handle means mounted to each rudder shaft to effect selective independent pivoting of each rudder shaft relative to the bottom wall.

2. A water-ski board as set forth in claim 1 wherein each handle means includes a handle member, the handle member having a handle member post, the handle member post having a post flange, and a rudder shaft sleeve fixedly mounted between the top wall and the bottom wall orthogonally oriented relative to the top wall and the bottom wall, wherein the rudder shaft sleeve includes a rudder shaft sleeve upper flange in contiguous communication with the top wall, and a rudder shaft sleeve lower flange in contiguous communication with the bottom wall, with the handle post lower flange in rotative communication with the rudder shaft sleeve upper flange.

3. A water-ski board as set forth in claim 2 wherein each handle member includes a handle bar arranged parallel relative to the board top wall, and a U-shaped support, wherein the handle bar is mounted to the U-shaped support, and the U-shaped support is mounted to the handle post.

4. A water-ski board as set forth in claim 3 including a plurality of parallel convex trough members orthogonally intersecting and directed through the planar rear wall extending from the planar rear wall to a spaced orientation relative to a respective handle bar, and each trough member includes a concave arcuate trough floor canted upwardly from the rear wall to the top wall coextensive with the trough member.

* * * * *